US006434862B1

(12) United States Patent
Hren

(10) Patent No.: US 6,434,862 B1
(45) Date of Patent: Aug. 20, 2002

(54) SKEWED DIPPER

(76) Inventor: William J. Hren, 2543 N. 89th St., Wauwatosa, WI (US) 53226

( * ) Notice: Subject to any disclaimer, the term of this patent is extended or adjusted under 35 U.S.C. 154(b) by 0 days.

(21) Appl. No.: 09/635,324

(22) Filed: Aug. 9, 2000

(51) Int. Cl.[7] ..... E02F 3/60
(52) U.S. Cl. ..... 37/398; 37/444; 37/446; 414/722
(58) Field of Search ..... 37/394, 395, 397, 37/398, 443, 445, 444, 446, 452, 449; 414/690, 694, 685, 722, 726; 172/713, 772, 772.5

(56) References Cited

U.S. PATENT DOCUMENTS

| | | | | |
|---|---|---|---|---|
| 2,336,729 | A | | 12/1943 | Harris et al. |
| 2,472,076 | A | | 6/1949 | Howe |
| 3,278,057 | A | * | 10/1966 | Drollinger et al. |
| 3,933,260 | A | * | 1/1976 | Kronlokken et al. |
| 4,006,832 | A | | 2/1977 | Auxer et al. |
| 4,517,756 | A | | 5/1985 | Olds et al. |
| 4,677,579 | A | * | 6/1987 | Radomilovich |
| 5,063,694 | A | | 11/1991 | McCreary, Jr. |
| 5,251,389 | A | * | 10/1993 | Bessey |
| 5,283,965 | A | * | 2/1994 | Clendenning |
| 5,499,463 | A | * | 3/1996 | Profio et al. |
| 6,219,946 | B1 | * | 4/2001 | Soczka |

FOREIGN PATENT DOCUMENTS

| | | |
|---|---|---|
| SU | 1054-507 A | 7/1980 |

* cited by examiner

*Primary Examiner*—Victor Batson
(74) *Attorney, Agent, or Firm*—David R. Price; James Earl Lowe, Jr.

(57) ABSTRACT

A power shovel including a frame, a boom mounted on the frame, a crowd drive mechanism mounted on the boom, and a dipper handle supported by the crowd mechanism. A dipper is connected to the handle for movement therewith, the dipper defining material receiving and material discharging openings with substantially identical areas. The dipper includes a generally planar back wall, a generally planar front wall, the front wall being opposite and substantially parallel to the back wall, generally trapezoidal and substantially parallel side walls connecting the back wall and the front wall, and a lip arranged along an upper edge of the front wall. A lip angle of the dipper is between three and five degrees, and a tooth angle is between 46 and 50 degrees. The dipper also includes a dipper door that is mounted on the back wall for pivotable movement relative thereto, the door and the back wall forming an acute angle when the door is closed, and the door and the front wall forming an obtuse angle when the door is closed.

5 Claims, 2 Drawing Sheets

SKEWED DIPPER

FIELD OF THE INVENTION

The present invention relates to power shovels having a dipper for excavating earthen material.

BACKGROUND OF THE INVENTION

There are many known earth-moving apparatuses. Typical power shovels or excavators use a bucket or dipper assembly to scoop earthen material from horizontal or vertical faces. A conventional power shovel has a boom, and the dipper is mounted on the boom via a crowd mechanism. The crowd mechanism includes a crowd pinion on the boom, and crowd rack as part of the dipper handle which pivots about the pinion and which moves translationally along the pinion. The dipper is mounted on the end of the handle. The bucket or dipper is normally provided with sharp teeth to provide a digging action against the surface being worked and further includes a cavity for collecting the material so removed. Once the earthen material is received within the dipper, the dipper is typically moved to another location for transfer of the material. The material is usually discharged into a dump truck, onto a conveyor, or merely onto a pile.

Each of the dippers in these power shovels typically has orthogonal sides and a heel band that is mounted on a lower end of the dipper. The heel band is essentially a wear bar attached to the lower end of the front wall of the dipper to prevent excess wear on the dipper walls by contact with earthen material during excavation. Each dipper typically has a lip at the top of the front wall to accommodate attachment of teeth to the dipper.

A lip angle is defined as the angle between the front wall of the dipper and the lip and is typically between ten and eighteen degrees. The plane of the teeth usually coincides with the lip and forms a tooth angle with an imaginary line drawn tangent to the pitch line of the crowd pinion and intersecting the upper surface of the lip, the tooth angle being between 46 and 50 degrees when crowd rack is fully extended. One known power shovel construction has a lip angle of three to five degrees but a tooth angle of greater than 50 degrees. In some prior art dippers with a zero to five degree lip angle, the front and rear dipper walls are not parallel, creating a sort of funnel in the dipper because the area of the top opening of the dipper becomes larger than the area of the bottom opening of the dipper.

One problem with conventional dippers is the inordinate wear on the heel band at the lower end of the dipper as the dipper is repeatedly drawn through earthen material. Another problem with conventional dippers is the incomplete filling of the dipper on each pass, resulting in an inefficient use of the power shovel. Previous attempts at altering the shape of a dipper have resulted in material clogging due to the creation of a funnel-like dipper where the top opening is larger than the bottom opening or resulting in a tooth angle outside the recommended limits for desirable angle of attack relative to earthen bank.

SUMMARY OF THE INVENTION

The invention provides a skewed dipper shape to protect the heel band from wear, thus reducing the required replacement frequency of the heel band. The invention also provides a skewed dipper that is capable of being substantially completely filled in every pass so that a minimum number of dipper passes are needed to move a given amount of earth. At the same time, the area of the material receiving opening at the top of the dipper is substantially identical to the area of the material discharging opening at the bottom of the dipper, allowing material to pass through the dipper unimpeded.

In particular, the invention provides a power shovel including a frame, a boom mounted on the frame, and a crowd drive, mechanism mounted on the boom, the mechanism including a crowd pinion having a pitch diameter. The power shovel also includes a dipper handle supported by the crowd mechanism for translational movement relative to the boom and for pivotable movement relative to the boom. A dipper is connected to the handle for movement therewith, the dipper including a generally planar front wall defining a plane and having an upper edge, and a generally planar lip defining a plane and arranged along the upper edge of the front wall, the lip having an upper surface. The plane of the lip forms a lip angle with the plane of the front wall, the lip angle being between three and five degrees. The plane of the teeth is usually in line with the plane of the lip forms a tooth angle with an imaginary line drawn tangent to the pitch diameter of the crowd pinion and intersecting the upper surface of the lip where the tooth is attached, the tooth angle being between 46 and 50 degrees.

In addition, the invention provides a power shovel including a frame, a boom mounted on the frame, and a crowd drive mechanism mounted,on the boom, the mechanism including a crowd pinion having a pitch diameter. The power shovel also includes a dipper handle supported by the crowd mechanism for translational movement relative to the boom and for pivotable movement relative to the boom. A dipper is connected to the handle for movement therewith, the dipper defining a material receiving opening and a material discharging opening, each opening being generally rectangular and having an area, the areas of the receiving and discharging openings being substantially identical. The dipper includes a generally planar back wall defining a plane and including a lower end, a generally planar front wall defining a plane, the front wall being opposite to the back wall and substantially parallel to the back wall, the front wall having an upper edge, and generally trapezoidal and substantially parallel side walls connecting the back wall and the front wall. The dipper also includes a dipper door that defines a plane and that is mounted on the lower end of the back wall for pivotable movement relative thereto for opening and closing the discharging opening. The plane of the door and the plane of the back wall form a right angle when the door is closed, and the plane of the door and the plane of the front wall form a right angle when the door is closed.

Because the dipper is skewed, the heel band is approximately twelve inches behind where it would be in an orthogonal prior art dipper. As a result, the heel band experiences less wear because it is at least partially elevated away from the digging path followed by the dipper especially during initial crowd thrust into the bank.

Additionally, the skewed shape of the dipper allow for greater penetration of the dipper lower into an earthen bank because heel band interference with the earthen bank is dramatically curtailed. This is especially advantageous in shallow bank applications where good dipper fill factors are difficult to achieve.

Further, the skewed shape of the dipper allows the power shovel to extend the reach of the dipper teeth along the floor directly in front of the power shovel, extending the flat floor reach (limits) on which the power shovel can move. There is less of a need for bulldozers to clean up the floor in front of the power shovel. As a result, the power shovel may also be maneuvered closer to the bank.

Further, the skewed shape of the dipper allows more space for the dipper to be moved down and back toward the power shovel because the heel band has more clearance from the front of the power shovel track.

Further, the skewed shape of the dipper allows users to investigate the advantages of decreasing the tooth angle below 46 degrees in certain types of sticky material. Without the skew this cannot be done without drastically aggravating heel band interference with the bank.

Finally, the skewed shape of the dipper allows the earth it has dug up to more completely fill the dipper and the power shovel to more efficiently move earth due to fewer necessary digging cycles.

Other features and advantages of the invention will become apparent to those skilled in the art upon review of the following detailed description, claims, and drawings.

Figure 1:
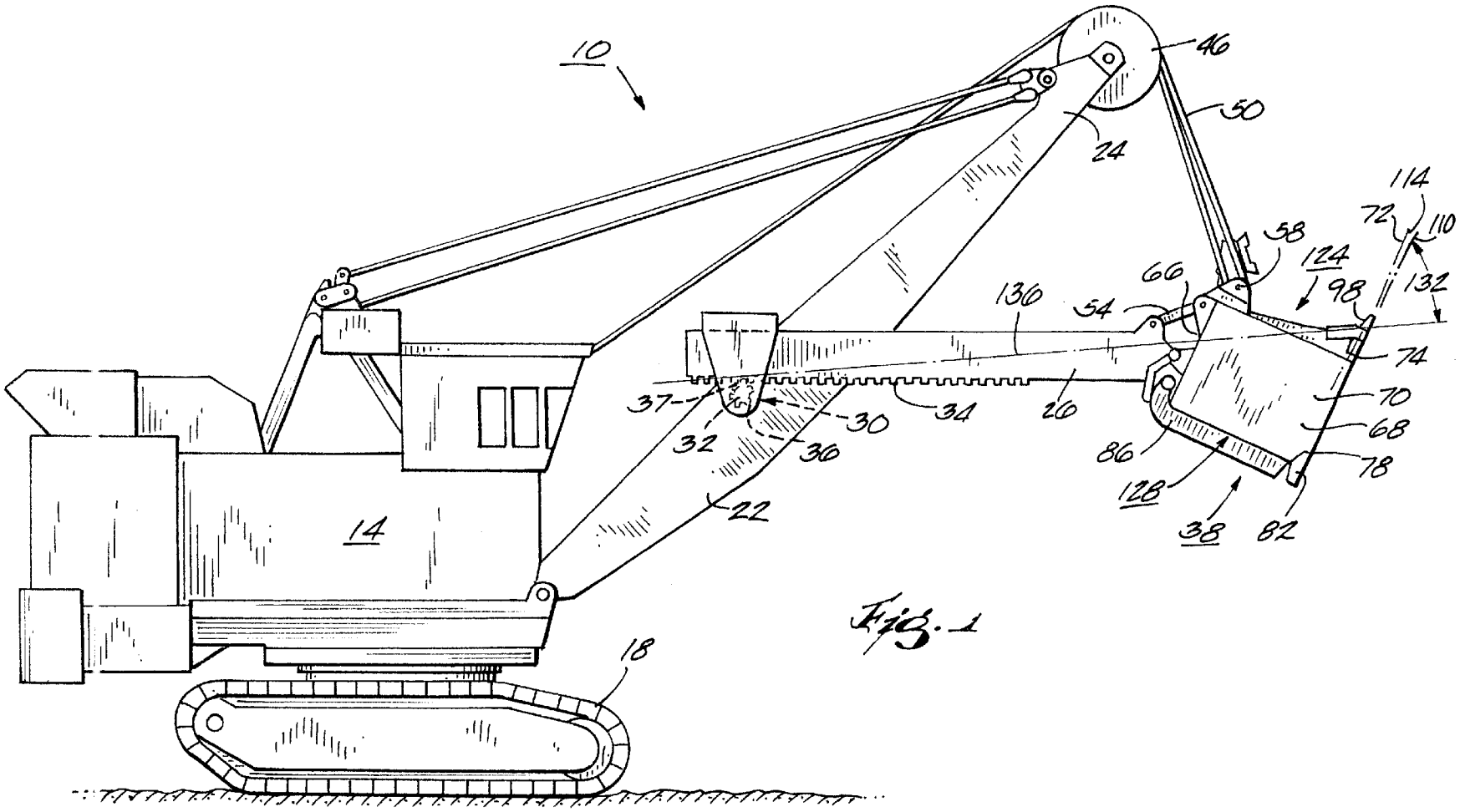
FIG. 1 is an elevation view of a power shovel embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENTS

FIG. 1 illustrates a power shovel 10 embodying the present invention. The power shovel 10 has some elements similar to the power shovel described in U.S. Pat. No. 5,499,463, which is assigned to the assignee hereof, and which is herein incorporated by reference. It should be understood that the present invention is capable of use in other power shovels known in the art and power shovel 10 is only provided as an example of one such power shovel.

The power shovel 10 comprises a frame 14 supported for movement over the ground. Specifically, frame 14 is a revolvable upper frame mounted on a mobile base such as crawler tracks 18. A fixed boom 22 extends upwardly and outwardly from the frame 14. The boom has an outer end 24. A dipper handle 26 is mounted on the boom 22 for movement about a rack and pinion or crowd mechanism 30 for pivotable movement relative to the boom 22 about a generally horizontal dipper handle axis 32, and for translational (non-pivotable) movement relative to the boom 22. The crowd mechanism 30 includes a crowd rack 34 and a crowd pinion 36, the crowd pinion 36 having a pitch diameter 37 at which the crowd pinion 36 interfaces with the crowd rack 34 pitch line in all dipper handle positions. The crowd pinion 36 pivots about the dipper handle axis 32, and the dipper handle 26 pivots about the crowd pinion 36.

The dipper handle 26 has a forward end on which a dipper 38 is mounted for pivotable movement relative thereto. The dipper 38 is described in detail below. A sheave 46 is rotatably mounted on the outer end 24 of the boom 22, and a hoist cable or rope 50 extends over the sheave 46. The rope 50 has one end connected to a winch drum (not shown) mounted on the frame 14 and another end connected to the dipper 38. The rope 50 is connected to the dipper 38 for pivotable movement relative thereto about a horizontal pivot axis 58.

The angle of the dipper 38 is set by a pair of attenuators 54 (only one is shown) connected between the dipper 38 and the dipper handle 26. The attenuators 54 are typically mounted on each side of the dipper 38 and are preferably variable pitch braces fixed at a particular length. It should be understood that the dipper 38 could be connected to the dipper handle 26 in any suitable way.

The dipper 38 includes the back wall 66, the back wall 66 defining a plane, generally trapezoidal and opposite side walls 68 extending forwardly from and substantially perpendicular to the back wall 66, and a generally planar front wall 70 that is generally parallel to the back wall 66. The back wall 66, and thus the dipper 38, is connected to the dipper handle 26. The front wall 70 defines a plane 72 and includes an upper end 74 and a lower exterior surface 78. The dipper 38 is generally of an orthogonal box shape. A heel band 82 is attached to the lower exterior surface 78 of the front wall 70. The heel band 82 is a wear member used to protect the dipper 38 from wear as the dipper 38 is used to dig. The heel band 82 also acts to retain the latch bar of the dipper door so the door will not open when shut.

Figure 2:
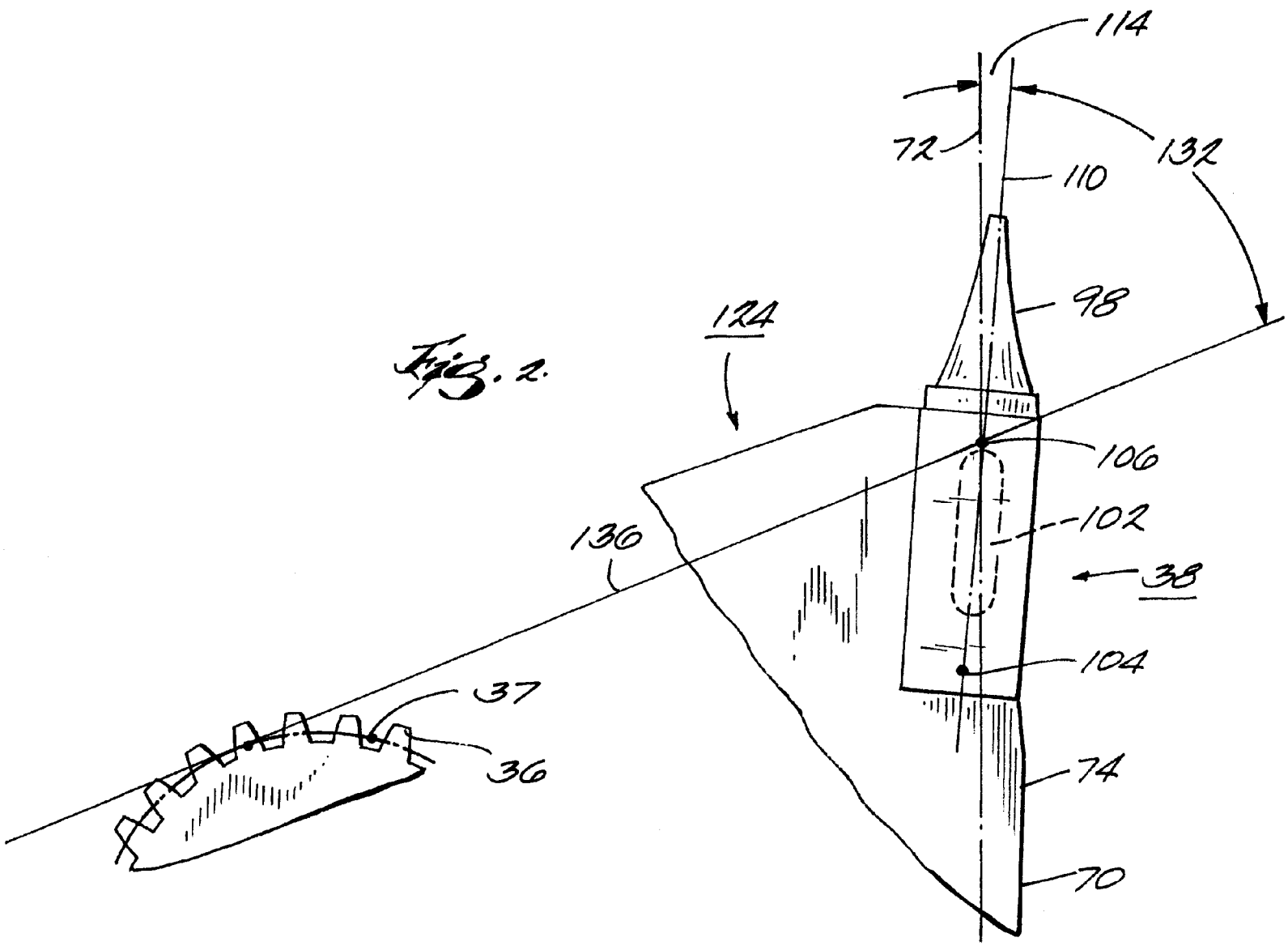
FIG. 2 is a schematic view of a portion of the power shovel illustrated in FIG. 1.

The dipper 38 also includes digging teeth 98 that extend outwardly from a generally planar lip 102 on the upper end of the front wall 70. The tooth, generally in line with the lip, defines a plane 110. The lip 102 includes an upper surface 106. In other embodiments (not shown), the lip 102 can have a slightly arcuate shape when seen from above, with a concave side of the lip 102 facing the back wall 66. In still other embodiments, downdraft teeth may be used. In such a case, plane 110 will no longer be in line with lip plane 104 but offset from the lip at an angle defined by the level of tooth downdraft. As illustrated in FIGS. 1 and 2, the plane 104 of the lip forms a lip angle 114 with the plane of the front wall 72. In the illustrated embodiment, the lip angle 114 is between three and five degrees. In prior art power shovels, the lip angle is typically ten to eighteen degrees.

The dipper 38 defines an upper or material receiving opening 124 and a lower or material discharging opening 128. The receiving opening 124 and the discharging opening 128 are generally rectangular and are generally equivalent in area, which avoids the situation in which a material-blocking funnel is formed in the dipper 38 where the receiving opening 124 is larger in area than the discharging opening 128.

The dipper 38 further includes the dipper door 86 pivotably connected to the back wall 66 adjacent to the lower end thereof. The dipper door 86 defines a door plane, and is movable between open and closed positions. The plane of the door and the plane of the front wall 72 form a right angle when the door is closed. The plane of the door and the plane of the back wall form a right angle when the door is closed.

As illustrated in FIGS. 1 and 2, a dipper tooth angle 132 is defined as the angle between the plane of the teeth 110 and an imaginary line 136 drawn tangent to the crowd pinion 36 at the crowd pinion pitch diameter 37 and intersecting the upper surface. 106 of the lip 102 (FIG. 2). The tooth angle 132 is generally chosen based on long-established optimum tooth angles determined by digging conditions and is typically between 46 and 50 degrees when the dipper handle is fully extended. The tooth angle 132 is typically held constant during a given digging campaign and is controlled by the attenuator length 54.

In effect, the lip angle 114 has not been reduced by altering the tooth angle 132, which remains constant for given conditions, but by changing the plane of the front wall 72 with respect to the lip 102 and teeth 98. In other words, although the tooth angle 132 and the position of the teeth 98 are held constant, the lip angle 114 is effectively reduced because the front wall 70 is moved to be more in line with the lip 102 and teeth 98. Thus, the dipper 38 is skewed from the unchanged lip 102 and teeth 98.

Because the front wall 70 is angled back more in line with the lip 102, the heel band 82 attached to the lower end 78 of the front wall 70 is approximately twelve inches behind where it would be in an orthogonal prior art dipper. As a result, the heel band 82 experiences less wear because it is at least partially elevated away from the digging path followed by the dipper 38 especially during initial crowd thrust into the bank.

Additionally, the skewed shape of the dipper 38 allows for greater penetration of the dipper lower into an earthen bank because heel band 82 interference with the earthen bank is dramatically reduced. This is especially advantageous in shallow bank applications where good dipper fill factors are difficult to achieve.

Further, the skewed shape of the dipper 38 allows the power shovel 10 to extend the reach of the dipper teeth along the floor directly in front of the power shovel 10, extending the flat floor reach (limits) on which the power shovel 10 can move. There is less of a need for bulldozers to clean up the floor in front of the power shovel 10. The power shovel 10 may also be maneuvered closer to the bank.

Further, the skewed shape of the dipper 38 allows more space for the dipper 38 to be. moved down and back toward the power shovel 10 because the heel band 82 has more clearance from the front of the power shovel track 18.

Further, the skewed shape of the dipper allows users to investigate the advantages of decreasing the tooth angle below 46 degrees in certain types of sticky material. Without the skew this cannot be done without drastically aggravating heel band interference with the bank.

Finally, the skewed shape of the dipper 38 allow the earth it has dug up to more completely fill the dipper 38 and the power shovel 10 to more efficiently move earth due to fewer necessary digging cycles.

As is generally known, a digging or excavating cycle of the power shovel 10 begins with the dipper handle 26 in a tucked position and the dipper door 86 in a closed position. In the closed position, the dipper door 86 closes the material discharge opening 128.

As the digging cycle continues, the dipper handle 26 is pivoted counterclockwise so that the dipper 38 contacts the ground or bank of material being excavated. As the dipper handle 26 is pivoted further counterclockwise, the dipper handle 26 is extended (crowded) as necessary for the dipper 38 to excavate as ground material passes into the dipper 38 through the material receiving opening 124. Finally, the dipper handle 26 reaches the more or less horizontal position as shown in FIG. 1. Once the dipper 38 has collected a load of material and has been moved to a proper location, the dipper door 86 is opened, whereby the load of material is discharged through the material discharging opening 128.

Various features of the invention are set forth in the following claims.

What is claimed is:

1. A power shover comprising:

a frame;

a boom mounted on the frame;

a crowd mechanism mounted on the boom, the mechanism including a crowd pinion having an apex;

a dipper handle supported by the crowd mechanism for translational and pivotable movement relative to the boom; and a dipper connected to the handle for movement therewith, the dipper including a generally planar front wall defining a plane and arranged having an upper edge, and a generally planar lip defining a plane and arranged along the upper edge of the front wall, the lip having an upper surface, the plane of the lip forming a lip angle with the plane of the front wall, the lip angle being between three and five degrees, a tooth attached to and extending from the lip, and the plane of the tooth further forming a tooth angle with an imaginary line drawn tangent to the apex of the crowd pinion and intersecting the upper surface of the lip, the tooth angle being between 46 and 50 degrees.

2. The power shovel of claim 1, the dipper further including a generally planar back wall being opposite to and substantially parallel with the front wall, the back wall defining a plane and including a lower end, and an orthogonal dipper door that defines a plane and that is mounted on the lower end of the back wall for pivotable movement relative thereto, the dipper door having opened and closed positions, the plane of the door and the plane of the back wall forming a right angle when the door is closed.

3. The power shovel of claim 2, the plane of the door and the plane of the front wall forming a right angle when the door is closed.

4. The power shovel of claim 1, the dipper defining a material receiving opening and a material discharging opening, each opening being generally rectangular and having an area, the areas of the receiving and discharging openings being substantially identical.

5. A power shovel comprising:

a frame;

a boom mounted on the frame;

a crowd mechanism mounted on the boom, the mechanism including a crowd pinion having an apex;

a dipper handle supported by the crowd mechanism for translational and pivotable movement relative to the boom; and a dipper connected to the handle for movement therewith, the dipper defining a material receiving opening and a material discharging opening, each opening being generally rectangular and having an area, the areas of the receiving and discharging openings being substantially identical, the dipper including a generally planar back wall defining a plane and including a lower end, a generally planar front wall defining a plane, the front wall being opposite to the back wall and substantially parallel to the back wall, the front wall having an upper edge, generally trapezoidal and substantially parallel side walls connecting the back wall and the front wall, and a generally planar lip defining a plane and arranged along the upper edge of the front wall, the lip having an upper surface, the plane of the lip forming a lip angle with the plane of the front wall, the lip angle being between three and five degrees, a tooth attached to and extending from the lip, and the plane of the tooth further forming a tooth angle with an imaginary line drawn tangent to the apex of the crowd pinion and intersecting the upper surface of the lip, the tooth angle being between 46 and50degrees, and a generally horizontal dipper door that defines a plane and that is mounted on the lower end of the back wall for pivotable movement relative thereto for opening and closing the discharging opening, the plane of the door and the plane of the back wall forming a right angle when the door is closed, and the plane of the door and the plane of the front wall forming a right angle when the door is closed.

* * * * *